US012397241B1

(12) United States Patent
Huang

(10) Patent No.: US 12,397,241 B1
(45) Date of Patent: Aug. 26, 2025

(54) CHILDREN'S CAR WITH CLEANING FUNCTION

(71) Applicant: Jiayang Huang, Fujian (CN)

(72) Inventor: Jiayang Huang, Fujian (CN)

( * ) Notice: Subject to any disclaimer, the term of this patent is extended or adjusted under 35 U.S.C. 154(b) by 0 days.

(21) Appl. No.: 19/090,362

(22) Filed: Mar. 25, 2025

(51) Int. Cl.
*A63H 17/38* (2006.01)
*A47L 9/00* (2006.01)
*A47L 13/24* (2006.01)

(52) U.S. Cl.
CPC ..... *A63H 17/38* (2013.01); *A47L 9/009* (2013.01); *A47L 13/24* (2013.01)

(58) Field of Classification Search
CPC ..... A47L 25/00; A47L 9/009; A47L 13/24; A47L 13/12; B62K 9/00; E01H 1/045
USPC ..... 446/468
See application file for complete search history.

(56) References Cited

U.S. PATENT DOCUMENTS 1,933,501 A * 10/1933 Allen ..... A63H 33/305 446/411
2,703,897 A * 3/1955 Malm ..... A47L 11/4072 15/48
3,197,918 A * 8/1965 Coggeshall ..... A63H 7/04 446/290
3,354,489 A * 11/1967 Ehrlich ..... B66F 9/18 15/83
3,959,922 A * 6/1976 Leistikow ..... A63H 33/30 446/144
4,031,659 A * 6/1977 Keller ..... A63H 17/05 446/427
4,595,380 A * 6/1986 Magers ..... A63H 17/38 446/451
4,917,648 A * 4/1990 Hartje ..... A63H 17/05 446/427
5,378,191 A * 1/1995 Ryaa ..... A63H 33/305 446/144
5,435,768 A * 7/1995 Dunleavy ..... A63H 17/05 446/427
5,920,939 A * 7/1999 Worwag ..... A47L 9/0411 15/83

(Continued)

FOREIGN PATENT DOCUMENTS

CN 202847908 U * 4/2013 ..... A47L 13/12

OTHER PUBLICATIONS

Jiazhiyi, Machine Translation of CN202847908U. uploaded May 13, 25, Espacenet.com, 2 pages.*

*Primary Examiner* — Eugene L Kim
*Assistant Examiner* — Matthew B Stanczak

(57) ABSTRACT

The invention provides a children's car with cleaning function, comprising: a car body provided with a storage portion; a connecting frame, whose one end is connected with the car body, and the other end is provided with a connecting portion; and a cleaning tool head detachably connected with the connecting portion. The connecting frame includes an expanded state and a folded state; when the connecting frame is in the expanded state, the connecting frame expands to an outer side of the car body; when the connecting frame is in the folded state, the connecting portion is separated from the cleaning tool head and the connecting frame is located on the storage portion. When the cleaning function is not used, the cleaning tool head is detached from the connecting frame, and the connecting frame is folded to the storage portion, facilitating children to drive children's cars for fun.

9 Claims, 5 Drawing Sheets

(56) References Cited

U.S. PATENT DOCUMENTS 6,264,528 B1 * 7/2001 Doan ..... A63H 17/06 446/466
6,272,946 B1 * 8/2001 Roux ..... A63H 17/38 74/498
6,405,817 B1 * 6/2002 Huntsberger ..... B62K 9/00 280/47.11
6,485,351 B2 * 11/2002 Bruder ..... A63H 17/05 446/427
6,619,677 B2 * 9/2003 Wei ..... B62K 9/00 280/87.021
6,949,000 B1 * 9/2005 Antoine ..... A63H 33/007 446/237
6,968,587 B2 * 11/2005 Grey ..... A47L 5/30 15/377
7,143,461 B2 * 12/2006 Spooner ..... A47L 11/4072 15/41.1
7,175,501 B2 * 2/2007 Choi ..... B62K 9/00 446/469
7,527,293 B1 * 5/2009 Wang ..... B62D 1/10 280/771
7,794,303 B2 * 9/2010 Cassidy ..... A63H 33/30 446/460
7,967,317 B2 * 6/2011 Ewringmann ..... E01H 1/056 280/288.4
8,469,369 B1 * 6/2013 McCarthy ..... B62K 9/00 280/282
10,265,637 B2 * 4/2019 Bernbaum ..... B62B 7/12
11,918,932 B2 * 3/2024 Marlor ..... A63H 33/30
2004/0034952 A1 * 2/2004 Ho ..... A47L 11/4041 15/48.1
2009/0203293 A1 * 8/2009 Ewringmann ..... E01H 1/056 15/88.4
2013/0029560 A1 * 1/2013 Mayson ..... A63H 17/38 446/468
2014/0099861 A1 * 4/2014 Mayson ..... A63H 17/36 446/468
2023/0414051 A1 * 12/2023 Foss ..... A47L 9/242
2024/0000276 A1 * 1/2024 Millington ..... A47L 9/165
2024/0292990 A1 * 9/2024 Hamilton ..... A47L 9/2857
2024/0375702 A1 * 11/2024 Cui ..... B62D 1/10
2025/0083062 A1 * 3/2025 Cui ..... A63H 17/38

* cited by examiner

CHILDREN'S CAR WITH CLEANING FUNCTION

TECHNICAL FIELD

The present invention relates to the technical field of children's cars, and particularly relates to a children's car with cleaning function.

BACKGROUND

A children's car is a kind of toy car driven by an electric motor that children can drive. It not only helps to exercise children's physical abilities, but also enhances their intelligence and allows them to experience the fun of being "drivers". At present, most of electric toy cars for children on the market only provide simple recreational functions, making their functions relatively limited. Some children's toy cars are provided with cleaning tools on car bodies, and the car bodies are connected to the cleaning tools through connecting frames, so that the children can experience the labor of cleaning the ground while having fun. However, the cleaning tools on these children's toy cars cannot be disassembled, making it inconvenient to store the cleaning tools and the connecting frames when the cleaning function is not used.

SUMMARY

The present invention provides a children's car with cleaning function, aiming to solve the problem that the cleaning tools on the children's cars in the existing technology cannot be disassembled, making it inconvenient to store the cleaning tools and the connecting frames used for connecting the cleaning tools to the car bodies when the cleaning function is not used.

In order to achieve the above technical problems, the present invention adopts the following technical solutions.

A children's car with cleaning function, comprises a car body, which is provided with a storage portion;

a connecting frame, whose one end of the connecting frame is connected with the car body, and the other end is provided with a connecting portion; and a cleaning tool head, which can be disassembly connected with the connecting portion;

wherein the connecting frame includes an expanded state and a folded state; when the connecting frame is in the expanded state, the connecting frame expands to an outer side of the car body; when the connecting frame is in the folded state, the connecting portion is separated from the cleaning tool head and the connecting frame is located on the storage portion.

As a further solution, when the connecting frame is in the expanded state, the connecting frame expands to a front side of the car body, and the cleaning tool head is located on the front side of the car body.

Based on the above technical solution, the above settings make it convenient for the children to observe while driving the children's cars forward.

As a further solution, there are two connecting frames, namely a left connecting frame and a right connecting frame; the left connecting frame is located on a left side of the car body, and the right connecting frame is located on a right side of the car body.

There are two storage portions, namely a left storage portion and a right storage portion; the left storage portion is located on the left side of the car body, and the right storage portion is located on the right side of the car body.

When the connecting frame is in the folded state, the left connecting frame is located on the left storage portion, and the right connecting frame is located on the right storage portion.

Based on the above technical solution, the two connecting frames are arranged and folded correspondingly on the two storage portions, so as to facilitate users' operations.

As a further solution, wherein the storage portion is configured as a storage slot, and when the connecting frame is in the folded state, the connecting frame is rotated into the storage slot.

As a further solution, the cleaning tool head is provided with a connecting base, and the connecting base is provided with two slots, namely a left slot and a right slot. The connecting portion on the left connecting frame is detachably inserted into the left slot through a bolt, and the connecting portion on the right connecting frame is detachably inserted into the right slot through the bolt.

Based on the above technical solution, the above settings are convenient for the users to quickly install the cleaning tool head to the connecting frame or remove it from the connecting frame, and the two connecting portions are inserted into the two slots through the bolts respectively, so that the cleaning tool head is more stably connected with the car body.

As a further solution, the connecting base is provided with a wrenching component, a middle part of the wrenching component is hinged on the connecting base through an articulated shaft, a wrenching portion is provided on a rear part of the wrenching component, and the left and right bolts are located on left and right sides of a front part of the wrenching component, respectively.

When the wrenching portion is wrenched downward, the left and right bolts are separated from the left and right slots upwards, respectively; when the wrenching component is released, the left and right bolts are inserted downwards into the left and right slots, respectively.

Based on the above technical solution, by setting the wrenching component, it is convenient for the users to operate and disassemble the cleaning tool head.

As a further solution, the connecting frame is rotatably connected with the car body through a rotating shaft.

Based on the above technical solution, the connecting frame is rotatably connected with the car body, which is convenient to switch the connecting frame between the expanded state and the folded state.

As a further solution, the car body is provided with an accommodating groove, and an opening of the accommodating groove is detachably provided with a cover.

Based on the above technical solution, by setting the accommodating groove, the cleaning tool head can be placed into the accommodating groove when the cleaning function is not used, which is convenient for storage.

As a further solution, the cleaning tool head is a mop head or a vacuum cleaner head.

As a further solution, a handle is detachably provided on the cleaning tool head.

Based on the above technical solution, when the cleaning tool head needs to be detached from the car body for individual use, the handle can be assembled onto the cleaning tool head to facilitate operation; when the cleaning tool head needs to be assembled to the car body for use, the handle can be detached from the cleaning tool head to facilitate the assembly operation.

As a further solution, wherein left and right ends of the handle are inserted into the slots and secured with the bolts.

As a further solution, a steering wheel is detachably provided on the car body.

Based on the above technical solution, the steering wheel can be disassembled, making it convenient to package, transport, and store the children's car.

The present invention has the following the beneficial effects.

The present invention provides a storage portion, a connecting frame and a cleaning tool head on a car body, and the cleaning tool head is detachably connected with the connecting portion. The connecting frame includes an expanded state and a folded state, so that when the cleaning function needs to be used, the connecting frame can be switched to the expanded state, thus to facilitate to connect the cleaning tool head, therefore children can experience the labor of cleaning the ground while driving the children's cars for fun. When the cleaning function doesn't need to be used, the cleaning tool head can be detached from the connecting frame, and the connecting frame can be folded on the storage portion, so as to facilitate children to drive the children's cars for fun. In addition, the cleaning tool head can be detached from the connecting frame, which is convenient for packaging and transportation.

BRIEF DESCRIPTION OF THE DRAWINGS

In order to illustrate the technical solutions in the embodiments of the present invention more clearly, the drawings required in the description of the embodiments will be briefly introduced below. It should be understood that the drawings described in the following are merely some embodiments of the present invention, and therefore should not be regarded as limitations of the scope. For those skilled in the art, other drawings can also be obtained according to the drawing without making any creative efforts.

Figure 1:
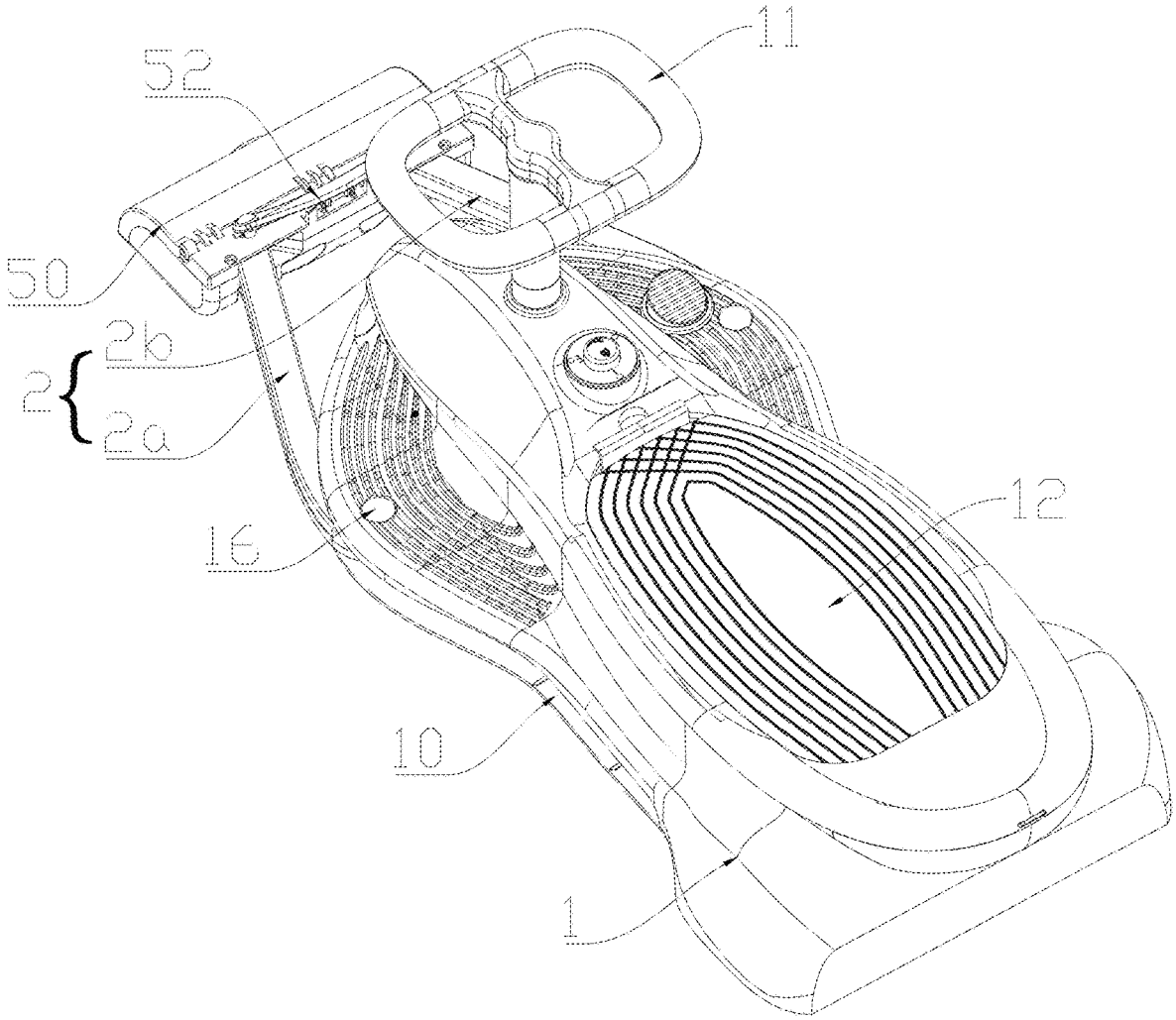
FIG. 1 is a structural schematic view of the children's car with cleaning function according to the present invention, showing a connecting frame connected to a mop head in a first orientation.

The reference numbers in the drawings are as follows:

car body 1; storage portion 10; left storage portion 10*a*; right storage portion 10*b* steering wheel 11; cover 12; front wheel 13; rear wheel 14; storage slot 15; rotating shaft 16; accommodating groove 17; mounting seat 18; connecting frame 2; left connecting frame 2*a*; right connecting frame 2*b*; connecting portion 21; mop head 3; vacuum cleaner head 4; connecting base 5; cleaning tool head 50; articulated shaft 51; wrenching component 52; wrenching portion 52*a*; bolt 53; left bolt 53*a*; right bolt 53*b*; slot 54; left slot 54*a*; right slot 54*b*; handle 6.

DETAILED DESCRIPTION OF EMBODIMENTS

The technical solutions in the embodiments of the present invention will be illustrated in detail in combination with the embodiments and the drawings. It should be understood that the specific embodiments described here are only used to explain the present invention and are not used to limit the present invention. Based on the embodiments of the present invention, all other embodiments obtained by a person skilled in the art without making creative efforts shall fall within the scope of the present invention.

As shown in FIG. 1 to FIG. 5, the present embodiment provides a children's car with cleaning function, which comprises:

- a car body 1, which is provided with a storage portion 10;
- a connecting frame 2, whose one end is connected with the car body 1, and the other end is provided with a connecting portion 21; and
- a cleaning tool head 50, which is detachably connected with the connecting portion 21.

The connecting frame 2 includes an expanded state and a folded state, when the connecting frame 2 is in the expanded state, the connecting frame 2 expands to an outer side of the car body 1, that is, to a front, rear, left or right side of the car body 1; when the connection frame 2 is in the folded state, the connecting portion 21 is separated from the cleaning tool head 50 and the connecting frame 2 is located on the storage portion 10. Specifically, when the cleaning function of the children's car is not used, the cleaning tool head 50 is detached first, and then the connecting frame 2 is folded in the storage portion 10.

As shown in FIG. 1 to FIG. 4, there are two front wheels 13 located on the left and right underneath a front side of the car body 1, and there are two rear wheels 14 located on left and right underneath a rear side of the car body 1. The car body 1 is provided with a steering wheel 11 and a riding portion 12 for children to ride and operate the car body 1. The steering wheel 11 can be configured to be detachably connected to the car body 1, so that the steering wheel 11 can be detached during packaging and transportation to facilitate easier packaging. Specifically, the steering wheel 11 is detachably connected to the car body 1 by means of a plug-in structure.

Specifically, the cleaning tool head 50 can be a mop head 3, a vacuum cleaner head 4, etc. In specific use, users can choose to assemble either the mop head 3 or the vacuum cleaner head 4 onto the connecting frame 2.

Figure 2:
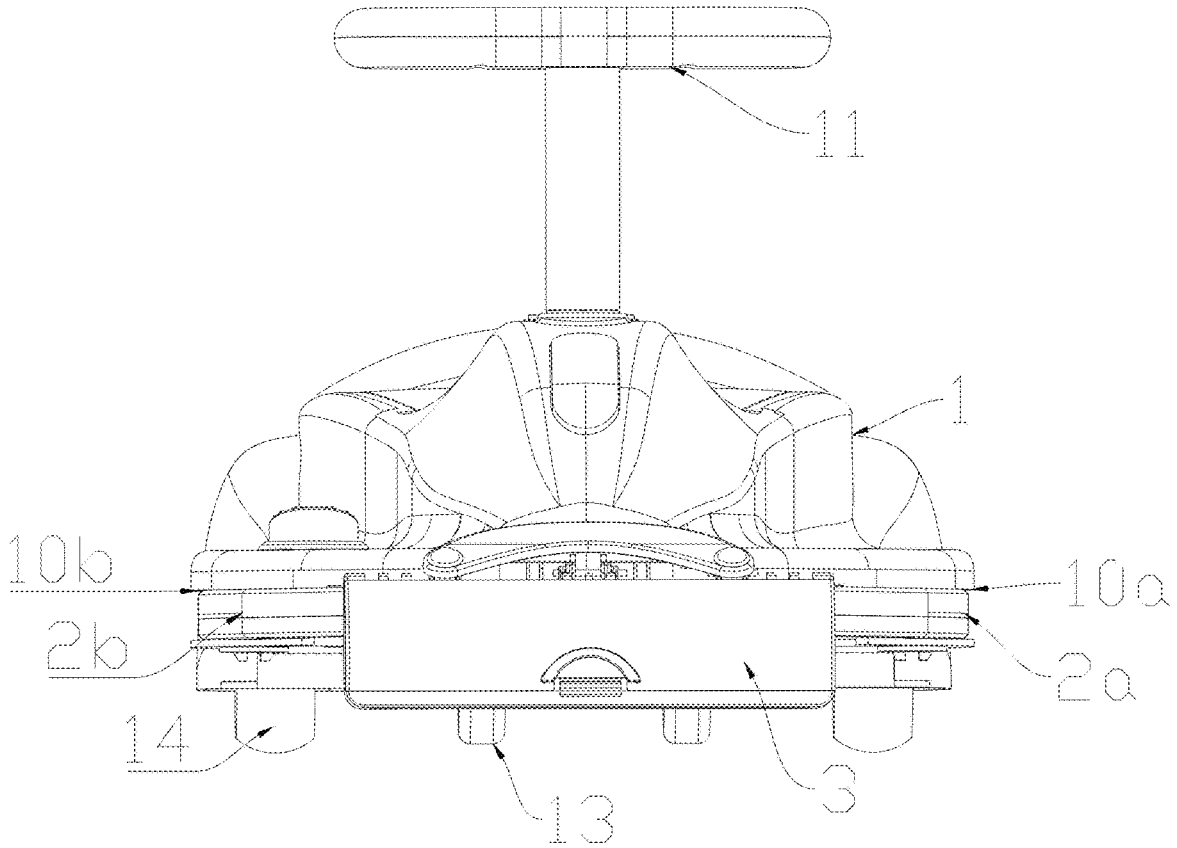
FIG. 2 is a structural schematic view of the children's car with cleaning function according to the present invention, showing the connecting frame connected to the mop head in a second orientation.
Figure 3:
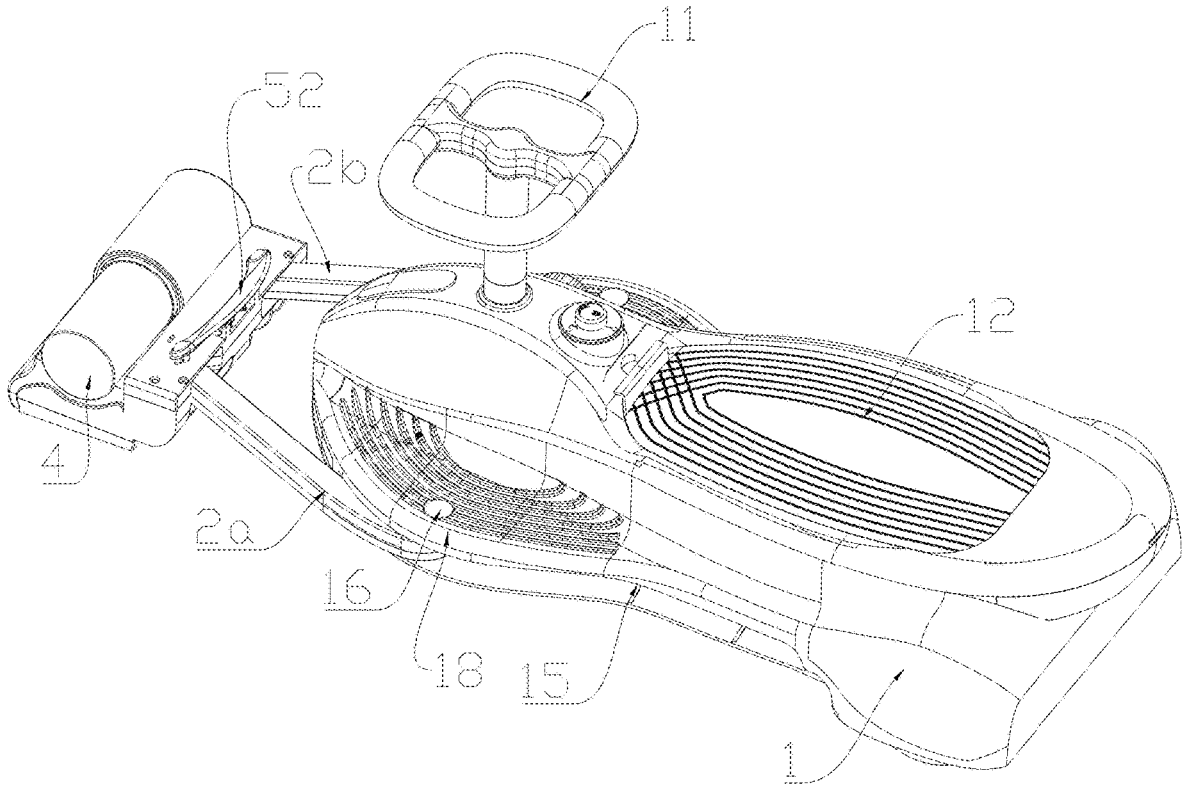
FIG. 3 is a structural schematic view of the children's car with cleaning function according to the present invention, showing the connecting frame connected to a vacuum cleaner head.

In some specific embodiments, as shown in FIG. 1 to FIG. 3, to facilitate the children's observation of the cleaning tool head while driving the children's car forward, a preferred solution of the present embodiment is that when the connecting frame 2 is in the expanded state, the connecting frame 2 is rotatably or slidably expanded to the front side of the car body 1, and the cleaning tool head 50 is located on the front side of the car body 1, and the cleaning tool head 50 is connected with the connecting portion 21 on the front side of the car body 1.

In some specific embodiments, as shown in FIG. 1 to FIG. 4, the connecting frame 2 is rotatably connected to the car body 1 through a rotating shaft 16. Specifically, a mounting seat 18 is provided on the car body 1, and the connecting frame 2 is rotatably connected to the mounting seat 18 through the rotating shaft 16. When the connecting frame 2 needs to be switched between the expanded state and the folded state, a quick switch can be achieved by rotating the connecting frame 2.

In some specific embodiments, as shown in FIG. 1 to FIG. 3, there are two connecting frames 2, namely a left connecting frame 2*a* and a right connecting frame 2*b*. The left connecting frame 2*a* is located on a left side of the car body 1, and the right connecting frame 2*b* is located on a right side of the car body 1.

There are two storage portions, namely a left storage portion 10*a* and a right storage portion 10*b*. The left storage portion 10*a* is located on the left side of the car body 1, and the right storage portion 10*b* is located on the right side of the car body 1.

When the connecting frame 2 is in the folded state, the left connecting frame 2*a* is located on the left storage portion 10*a*, and the right connecting frame 2*b* is located on the right storage portion 10*b*. Specifically, to ensure a more stable connection between the cleaning tool head 50 and the car body 1, the connecting portions 21 of the two connecting frames 2 are detachably connected to left and right sides of the cleaning tool head 50, respectively. Alternatively, it can also be set that the connecting portion 21 of each connecting frame 2 is separately connected to one of the cleaning tool head 50.

Figure 4:
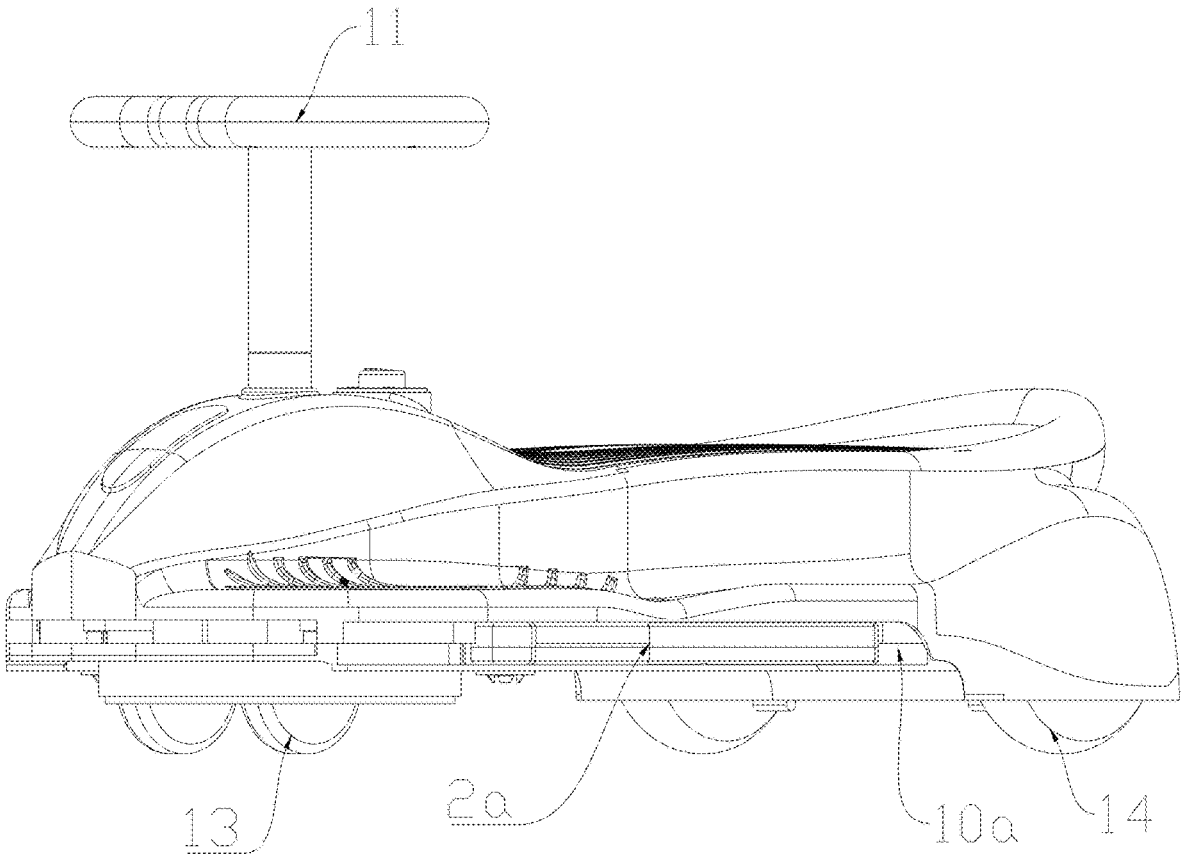
FIG. 4 is a structural schematic view of the connecting frame in a folded state.

In some specific embodiments, as shown in FIG. 4, in order to prevent the connecting frame 2 from occupying additional space when in the folded state, the storage portion 10 is configured as a storage slot 15 in this embodiment, and when the connecting frame 2 is in the folded state, the connecting frame 2 is rotated into the storage slot 15.

Figure 5:
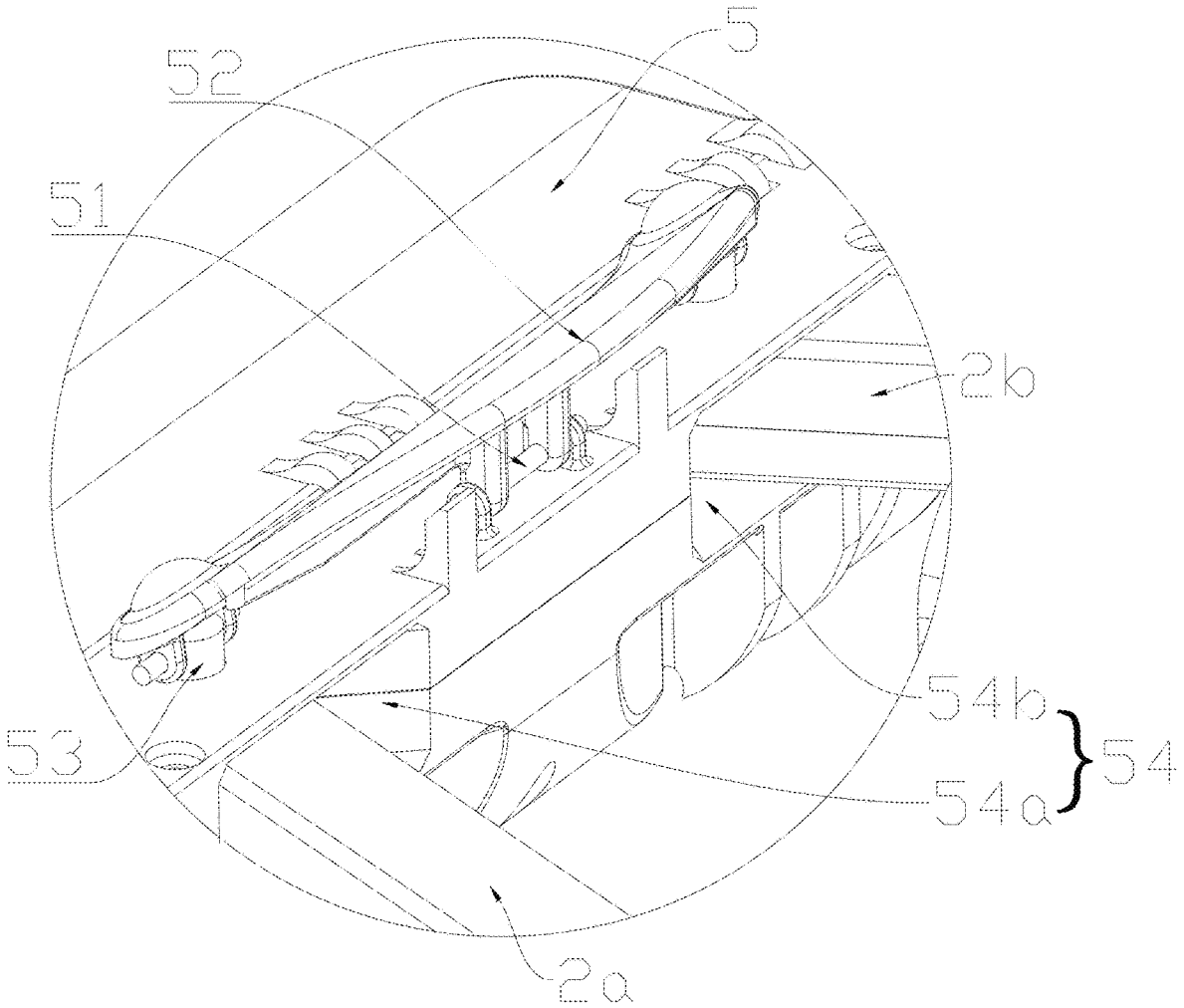
FIG. 5 is a structural schematic view that the connecting frame is connected to a cleaning tool head.

In some specific embodiments, as shown in FIG. 5, to facilitate the user to assemble the cleaning tool head 50 to or detach it from the connecting frame 2, the cleaning tool head 50 is provided with a connecting base 5, and the connecting base 5 is provided with two slots 54, namely a left slot 54*a* and a right slot 54*b*. The connecting portion 21 on the left connecting frame 2*a* is detachably inserted into the left slot 54*a* via a left bolt 53*a*, and the connecting portion 21 on the right connecting frame 2*b* is detachably inserted into the right slot 54*b* via a right bolt 53*b*. Specifically, each connecting portion 21 is provided with a bolt hole, and the bolt 53 is inserted from top to bottom through a top wall of the slot 54 and into the bolt hole, thereby firmly fixing the cleaning tool head 50 to the connecting base 5.

As shown in FIG. 5, in order to facilitate user's operations, the connecting base 5 is provided with a wrenching component 52, a middle part of the wrenching component 52 is hinged on the connecting base 5 through an articulated shaft 51, a wrenching portion is provided on a rear part of the wrenching component 52, and the left and right bolts 53*a*/53*b* are respectively located on left and right sides of a front part of the wrenching component 52.

When the wrenching portion is wrenched downward, the left and right bolts 53*a*/53*b* are respectively separated from the left and right slots 54*a*/54*b* upwards and the two connecting portions 21, so that the cleaning tool head 50 can be detached from the two connecting frames 2. When the wrenching portion is released, the left and right bolts 53 *a*/53*b* are inserted downward into the left and right slots 54 *a*/54*b*, respectively.

Figure 7:
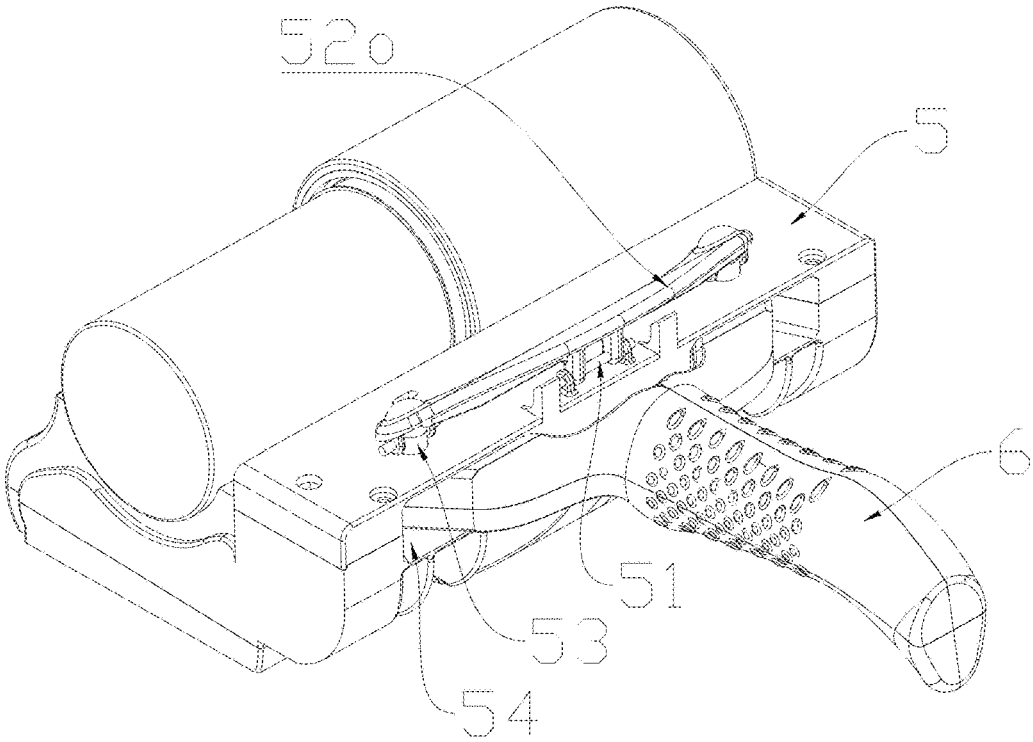
FIG. 7 is a structural schematic view that the vacuum cleaner head is connected to a handle.

In some specific embodiments, as shown in FIG. 7, for the convenience of users, a handle 6 can be detachably provided on the cleaning tool head 50. A specific method is that a connection between the cleaning tool head 50 and the handle 6 is the same as that between the cleaning tool head 50 and the connecting frame 2, that is, left and right ends of the handle 6 are inserted into the slots 54 and secured with the bolts 53. When the vacuum cleaner head 4 is connected to the car body 1 for use, the handle 6 on the vacuum cleaner head 4 is detached. When the vacuum cleaner head 4 is detached from the car body 1 for use, the handle 6 is assembled on the vacuum cleaner head 4.

Figure 6:
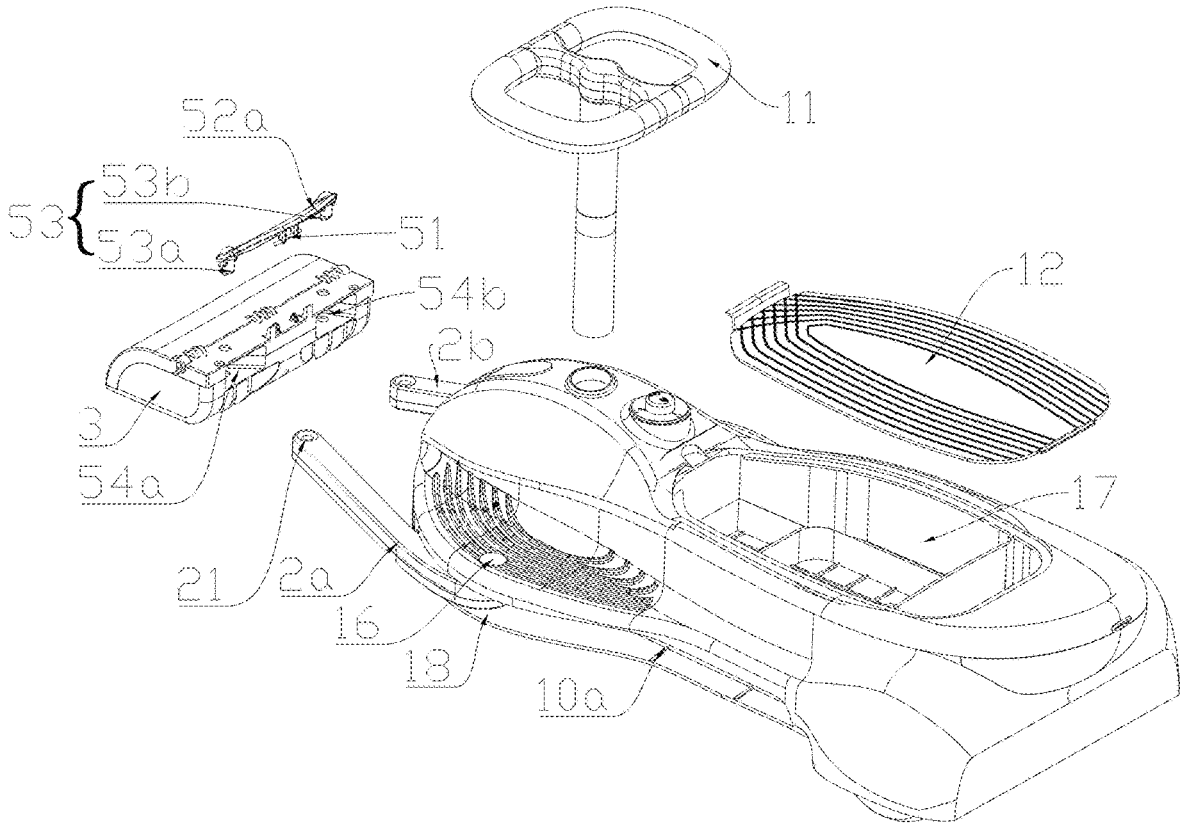
FIG. 6 is an exploded structural view of a car body and the cleaning tool head.

In some specific embodiments, as shown in FIG. 6, after the cleaning tool head 50 is detached from the connecting frame 2, in this embodiment, an accommodating groove 17 is provided on the car body 1 to facilitate the storage of the cleaning tool head 50. An opening of accommodating groove 17 is detachably provided with a cover 12. Specifically, the cover 12 is used for children to sit on. The accommodating groove 17 is provided below the cover 12 so as to make full use of the space.

The working principle is described as follow.

When the cleaning function of the children's car is used, the user can pull the connecting frame 2 out from the storage slot 15 and rotate it to the front side of the car body 1, and then assemble the mop head 3 or the vacuum cleaner head 4 onto the connecting frame 2. While the child drives the children's car forward, the ground is cleaned by the mop head 3 or the vacuum cleaner head 4. When the cleaning function is not in used, the mop head 3 or the vacuum cleaner head 4 is detached from the connecting frame 2, and then the connecting frame 2 is rotated back into the storage slot 15.

The prevent invention is not limited to the above optional implementation methods. Provided that there is no mutual conflict, various solutions can be combined arbitrarily. Anyone, under the inspiration of the present invention, may derive other forms of products. However, regardless of any changes made in their shapes or structures, any technical solutions that fall within the scope defined by the claims of the present invention shall be within the protection scope of the present invention.

What is claimed is:

1. A children's car with cleaning function, comprising a car body, which is provided with a storage portion;

a connecting frame, whose one end is connected with the car body, and the other end is provided with a connecting portion; and a cleaning tool head, which is detachably connected with the connecting portion;

wherein the connecting frame includes an expanded state and a folded state; when the connecting frame is in the expanded state, the connecting frame expands to an outer side of the car body; when the connecting frame is in the folded state, the connecting portion is separated from the cleaning tool head and the connecting frame is located on the storage portion, wherein there are two connecting frames, namely a left connecting frame and a right connecting frame: the left connecting frame is located on a left side of the car body, and the right connecting frame is located on a right side of the car body;

there are two storage portions, namely a left storage portion and a right storage portion: the left storage portion is located on the left side of the car body, and the right storage portion is located on the right side of the car body;

when the connecting frame is in the folded state, the left connecting frame is located on the left storage portion, and the right connecting frame is located on the right storage portion, wherein the cleaning tool head is provided with a connecting base, and the connecting base is provided with two slots, namely a left slot and a right slot: the connecting portion on the left connecting frame is detachably inserted into and connected with the left slot via a left bolt, and the connecting portion on the right connecting frame is detachably inserted into and connected with the right slot via a right bolt.

2. The children's car with cleaning function according to claim 1, wherein when the connecting frame is in the expanded state, the connecting frame expands to a front side of the car body, and the cleaning tool head is located on the front side of the car body.

3. The children's car with cleaning function according to claim 1, wherein the storage portion is configured as a storage slot, and when the connecting frame is in the folded state, the connecting frame is rotated into the storage slot.

4. The children's car with cleaning function according to claim 1, wherein the connecting base is provided with a wrenching component, a middle part of the wrenching component is hinged on the connecting base through an articulated shaft, a wrenching portion is provided on a rear part of the wrenching component, and the left and right bolts are located on left and right sides of a front part of the wrenching component, respectively;

when the wrenching portion is wrenched downward, the left and right bolts are separated from the left and right slots upwards, respectively; when the wrenching component is released, the left and right bolts are inserted downwards into the left and right slots, respectively.

5. The children's car with cleaning function according to claim 1, wherein the connecting frame is rotatably connected with the car body through a rotating shaft.

6. The children's car with cleaning function according to claim 1, wherein the car body is provided with an accommodating groove, and an opening of the accommodating groove is detachably provided with a cover.

7. The children's car with cleaning function according to claim 1, wherein the cleaning tool head is a mop head or a vacuum cleaner head.

8. The children's car with cleaning function according to claim 1, wherein a handle is detachably provided on the cleaning tool head.

9. The children's car with cleaning function according to claim 1, wherein a steering wheel is detachably provided on the car body.

* * * * *